United States Patent [19]

Austin

[11] Patent Number: 4,940,989

[45] Date of Patent: Jul. 10, 1990

[54] APPARATUS AND METHOD FOR MATCHING RADIATOR AND FEEDLINE IMPEDANCES AND FOR ISOLATING THE RADIATOR FROM THE FEEDLINE

[76] Inventor: Richard A. Austin, Powder House Rd., R.D. #1, Sandown, N.H. 03873

[21] Appl. No.: 282,677

[22] Filed: Dec. 12, 1988

Related U.S. Application Data

[63] Continuation-in-part of Ser. No. 856,236, Apr. 28, 1986.

[51] Int. Cl.[5] ..... H01Q 9/40

[52] U.S. Cl. ..... 343/749; 343/791; 343/792

[58] Field of Search ..... 343/749, 750, 858, 859, 343/860, 861, 790, 791

[56] References Cited

U.S. PATENT DOCUMENTS 3,588,903 6/1971 Hampton ..... 343/792

4,509,056 4/1985 Ploussios ..... 343/791

*Primary Examiner*—Rolf Hille

*Assistant Examiner*—Hoang Anh Le

*Attorney, Agent, or Firm*—Ross, Ross & Flavin

[57] ABSTRACT

A method of feeding a high impedance point of an antenna, such as the end of a ½ wave radiator. A resonant cavity is used for making an impedance match between the antenna and the feed line and forming a decoupling mechanism for forming the high impedance. Simultaneously, the cavity choke is formed with the open end facing toward the feed point for allowing a feed point impedance transformation between the feed line and the high impedance at the end of the ½ wave element and forming a high impedance point by its resonance for preventing the feed from flowing down along the outer surface of the choke and feed line.

12 Claims, 7 Drawing Sheets

APPARATUS AND METHOD FOR MATCHING RADIATOR AND FEEDLINE IMPEDANCES AND FOR ISOLATING THE RADIATOR FROM THE FEEDLINE

This application is a continuation-in-part of application Ser. No. 06/856,236 filed Apr. 28, 1986.

BACKGROUND OF THE INVENTION

1. Field of the Invention

My invention discloses new and useful improvements in antennae designs and comprehends usage in fixed station and mobile applications, in the VHF to microwave frequency regions.

It envisions a mechanism and a method for matching the impedance of a radiator to the impedance of a feedline and for isolating the radiator from the feedline.

The antennae are ground independent, capable of efficient performance without the need for any ground plane or ground simulating radial.

2. Description of the Prior Art

It has been known to use a non-resonant cavitylike construction overlapping a feed point for the purpose of impedance matching.

Berndt's patent #2,802,210 would appear to disclose such. In actuality, however, his cavity is not a choke. If it were, his lower element would be unable to function as described. He merely uses an extension of a choke surface for the tuning purpose. He doesn't use the open end of that choke for such purpose, nor does he use a dielectric in the tuning function.

Significantly, the cavity at his feedpoint is not resonant and does not form an open ¼ wave transmission line at the operating frequency or any length close to a ¼ wave at the operating frequency.

It is the impedance and not the resonance which he changes by a selective positioning of a short circuit slide 15.

Berndt's ¼ wave choke or filter isolates currents from his feedline and is the only ¼ wave device he uses.

Berndt's filter has an open circuit end facing away from his feedpoint and is not used for impedance matching or conversion from an unbalanced to a balanced feedline configuration.

The Berndt design relates to a center fed antenna relying on currents flowing down the outside of his conductive member.

Contrariwise, and as is about to appear in this disclosure, the antennae hereof are end fed, the cavities of which are sharply resonant chokes capable of preventing currents such as Berndt uses from flowing beyond their feedpoints and down the respective choke exteriors.

Equally deserving of citation is Hampton, #3,588,903, who provides no cavity function, his outer shell being short circuited by having its top and its bottom electrically connected to a coax shielding so as to allow a shorted secondary ¼ wave coaxial section where the outer braid of his coax defines an inner conductor and the inner surface of his outer shell defines an outer conductor. This essentially is the well-known configuration which provides the balun action.

He provides an insulating material but in no way is it utilized as a tuning device or is it adjustable in any way and/or for any purpose Patentee Hampton indicates that the tuning or matching function is accomplished by networks of series-parallel circuits 15.

Being fully aware of Ploussios, #4,509,056, I respect it only as a teaching of a choke system for defining the outward end of an antenna which in all cases are fed at a low impedance point, meaning an impedance value of approximately 70 ohms. Further he shows a center fed ½ wave dipole, known for its low impedance value. Contrariwise, my concept utilizes a high impedance feed point at the end of a ½ wave element and approximating 100,000 ohms.

Ploussios does not use his choke as a feed point impedance matching device. By an adjustment of his dielectric in the choke, he creates an infinite impedance but at the open end of the choke and not at the feedpoint. One end of his choke is shorted and the other open end is positioned away from his antenna feed point.

As will appear hereinafter, the choke of the present invention is shorted at one end and has an open end which faces toward the feedpoint so as to allow a feedpoint impedance transformation between the coaxial feed line (typically 50 ohms) and high impedance (approximately 100,000 ohms) at the end of a ½ wave element.

SUMMARY OF THE INVENTION

The novelty herein with respect to structural aspect lies in the use of a coaxial feedline having inner and outer conductors but distinguishable over any prior art reference in the respect that a radiator feedpoint is located at the terminus of the outer conductor and further in the respect that the inner conductor has an extension outwardly beyond the feedpoint, all in combination with an isolation choke, cylindrical in configuration, which circumscribes the feedline and is spaced from it, and has an open end and an opposite closed end, and more importantly, has the closed end electrically connected to the outer conductor and has the open end facing toward the feedpoint. The dielectric loading means is disposed between the choke and the outer conductor whereby the cavity is resonated and is formed a high impedance at the cavity's open end so as to preclude current flow along the choke outer surface and feedline while at the same time is attained a feedpoint impedance matching and a transition of the balanced feedpoint to the balanced feedline.

The method aspect of the invention lies in the method of feeding a high impedance point of an antenna, such as the end of a ½ wave radiator which visualizes the steps of utilizing a resonant cavity for making an impedance match between the antenna and the feedline by the means of devising a decoupling for forming the high impedance, while simultaneously forming the cavity choke with its open end facing toward the feedpoint and thereby allowing a feedpoint impedance transformation between the feedline and the high impedance at the end of the ½ wave element.

DESCRIPTION OF THE PREFERRED EMBODIMENTS

Figure 1:
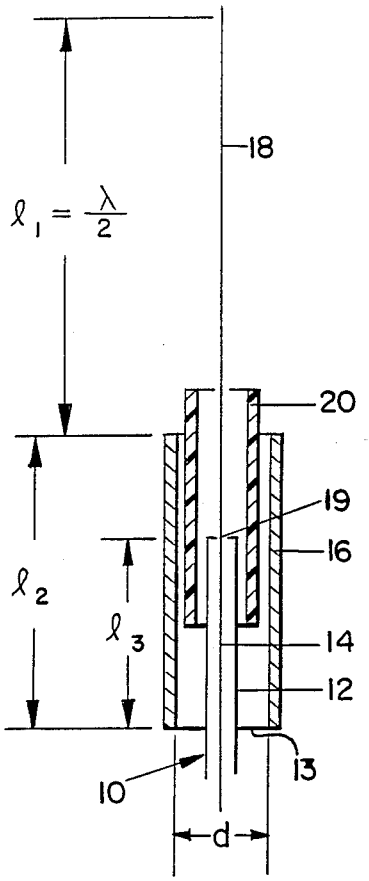
FIG. 1 is a schematic representation of an end-fed coaxial antenna embodying the spirit of the invention.

In FIG. 1, a coaxial dipole antenna is shown as comprising a coaxial transmission line or feedline 10 which will be understood to be connected to any appropriate transmitting or receiving equipment, which is not herein shown, same not forming a part of this invention.

Feedline 10 comprises an outer conductor 12 and an inner or center conductor 14, an extension of the inner conductor serving as a radiator 18 as will be made clear shortly.

An isolation choke 16, in the form of a conductive cylindrical shell or sleeve, is spaced from and circumscribes outer conductor 12, being short circuited thereto at its closed end 13.

The opposite end of the choke is open.

Extension 18 of inner conductor 14 extends from and outboard of feedpoint 19 defined at the upper terminus or open end of the choke.

Half wave lengths at the optimum operating frequency are represented by $l_1$, the distances between the terminus of the extension and the upper open end of the choke and between the upper and lower ends of the choke.

Choke 16 has an inside diameter denoted by d.

The inner surface of choke 16 and the outer surface of outer coaxial conductor 12 form a transmission line. At the frequency of operation, the effective length of this transmission line is slightly less than one TM quarter wavelength and, if used in this manner, would permit some energy coupling at the open end of the choke.

To effectively lengthen the length of this transmission line, a block 20 of a solid low-loss dielectric material, such as polystyrene, is positioned between outer coaxial conductor 12 and the inner surface of choke 16, being selected to make the electrical length of the transmission line formed by the inner surface of the choke and the outer conductor equal to one-quarter wavelength. It functions to tune the ½ wave extension 18 and also to tune the choke to a resonance at the operating frequency.

The impedance at the open end of the choke is thus infinite and coupling is prevented at that point.

The effective portion of the antenna will now be seen to extend from the upwardly facing open end of the choke to the end of the extension of the inner conductor and the length of the outer coaxial conductor below the closed end of the choke will be appreciated as not forming an active element of the antenna.

The ratio of the diameter of outer conductor to the inside diameter d of the choke defines an impedance which is somewhat higher than the impedance of the feedline.

The upper length of the choke, i.e. the length extending beyond the upper terminus of the outer conductor, together with the length of the extension $l_1$ (i.e. $l_1$ plus $l_2$ minus $l_3$), forms a first resonant tuner circuit.

Figure 2:
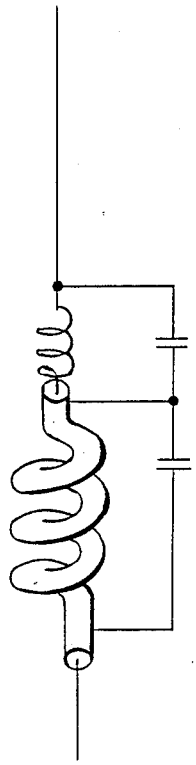
FIG. 2 is a schematic representation of the parallel relationship of the first and second resonant tuner circuits of the FIG. 1 showing.

Similarly, the length $l_2$ of the choke and the length $l_3$ of the outer conductor form a second resonant tuner circuit which is interactive with the first circuit, as shown schematically in FIG. 2.

The dielectric, when inserted a correct distance into the open end of the choke, compensates for the inherent interaction between, and precisely tunes, the first and second circuits to the required operating frequency.

The first circuit, when tuned to resonance, provides a proper impedance match to the feedline and the second circuit forms a high impedance at the operating frequency so as to prevent antenna currents from flowing down the exterior surface of the choke so as to effectively decouple the antenna radiating element from the feedline and/or from the vehicle surface.

So much for impedance matching at the end of a ½ wavelength element. The technique could be used to match other impedances at the ends of longer elements. Say, for instance, that the extension of the center conductor is of ⅝ wavelength, so as to provide that additional radiation gain. In such instance, to maintain a decoupling of the radiator from the feedline, the extension of the center conductor should not exceed ⅝ wavelength.

When additional radiation gain is a desideratum, other approaches are conceivable.

Figure 3:
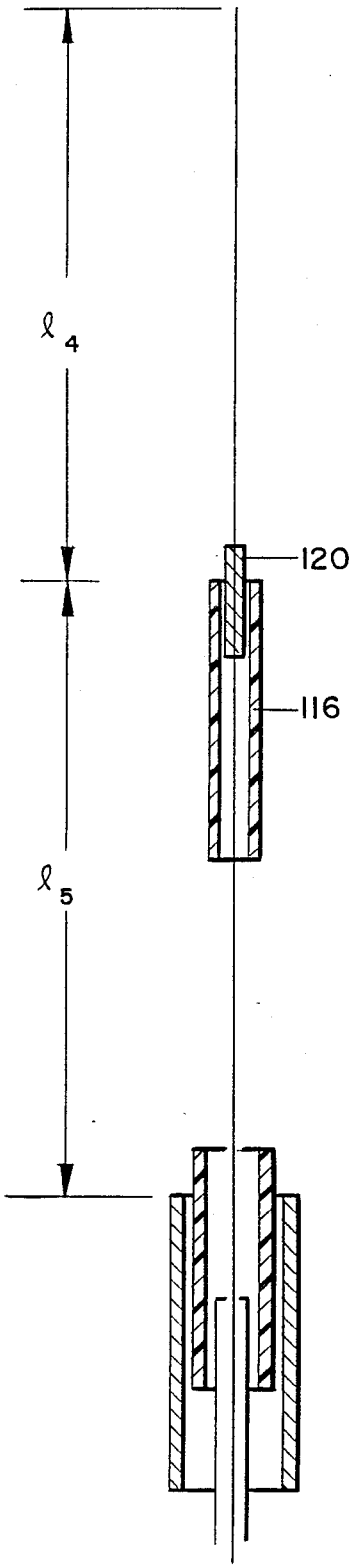
FIGS. 3 and 4 are schematic representations of commonly used approaches to the problem of providing additional radiation gain.
Figure 4:
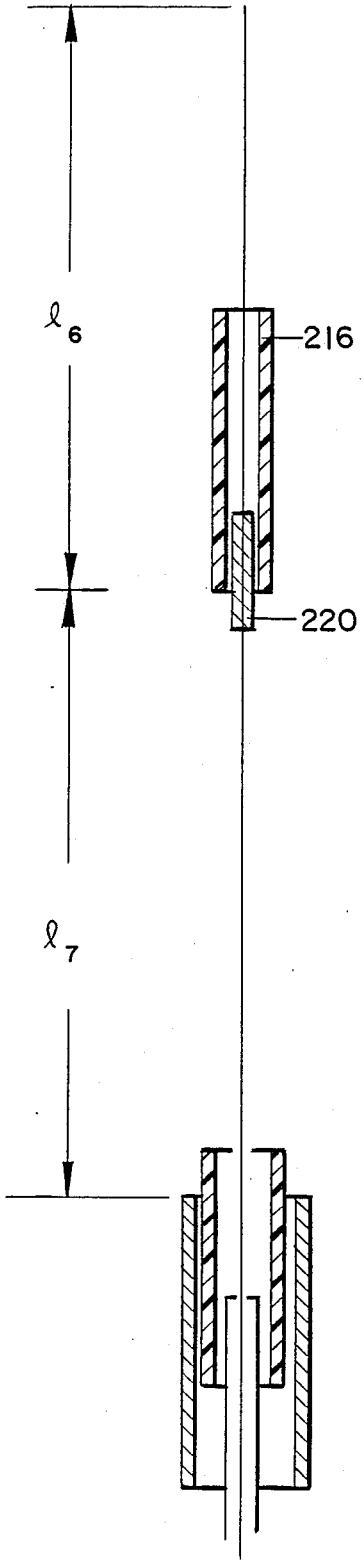

Lengths $l_4$ and $l_5$ (as in FIG. 3) and lengths $l_6$ and $l_7$ (as in FIG. 4) could each be ½ wavelengths or ⅝ wavelengths or combinations thereof, i.e. ⅝ over ½ wavelengths, with the ¼ wave choke delineated 116 as in FIG. 3 or 216 as in FIG. 4, and the dielectric delineated 120 as in FIG. 3 or 220 as in FIG. 4.

The chokes function, as before, to maintain a correct phasing of the current on its respective radiator.

Either choke (in FIGS. 3 and 4) might be substituted with a single wound or a bifilar wound coil.

Figure 5:
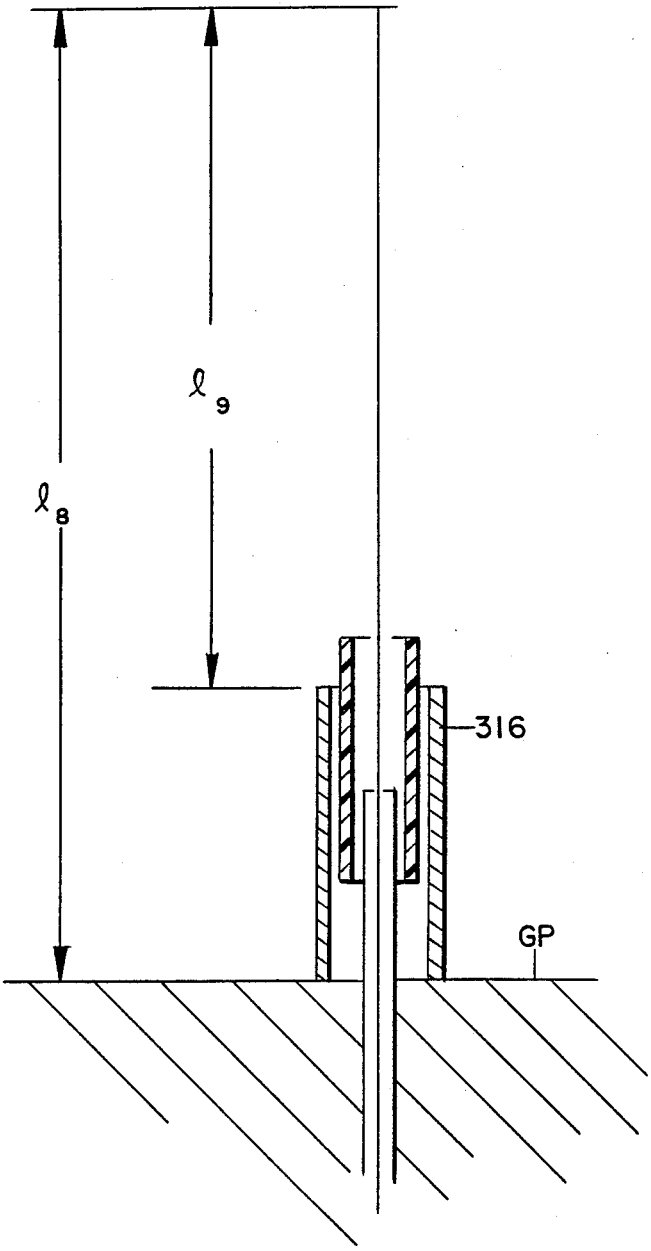
FIGS. 5 and 6 are schematic representations of methods of isolating a secondary frequency.
Figure 6:
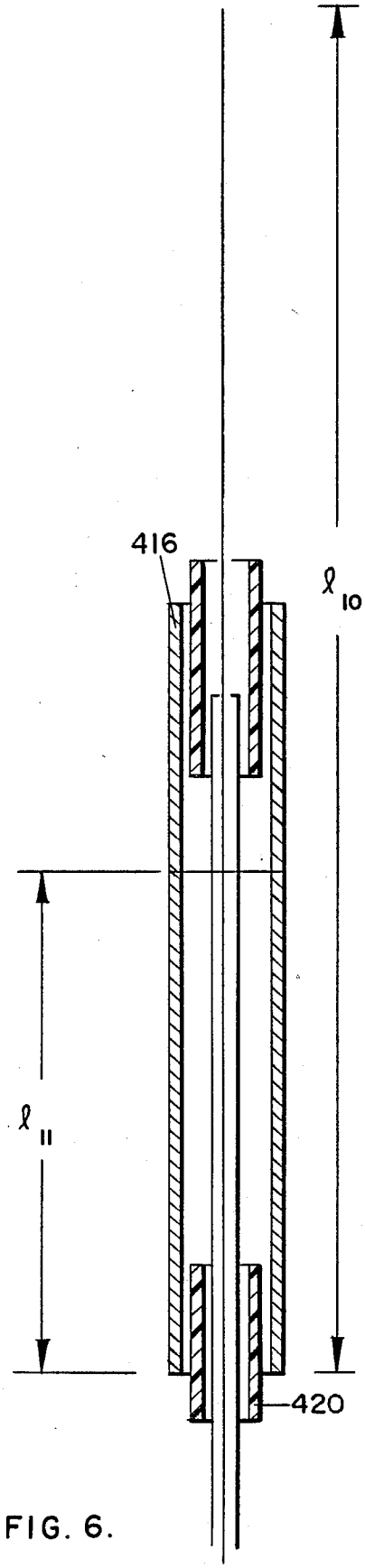
Figure 7:
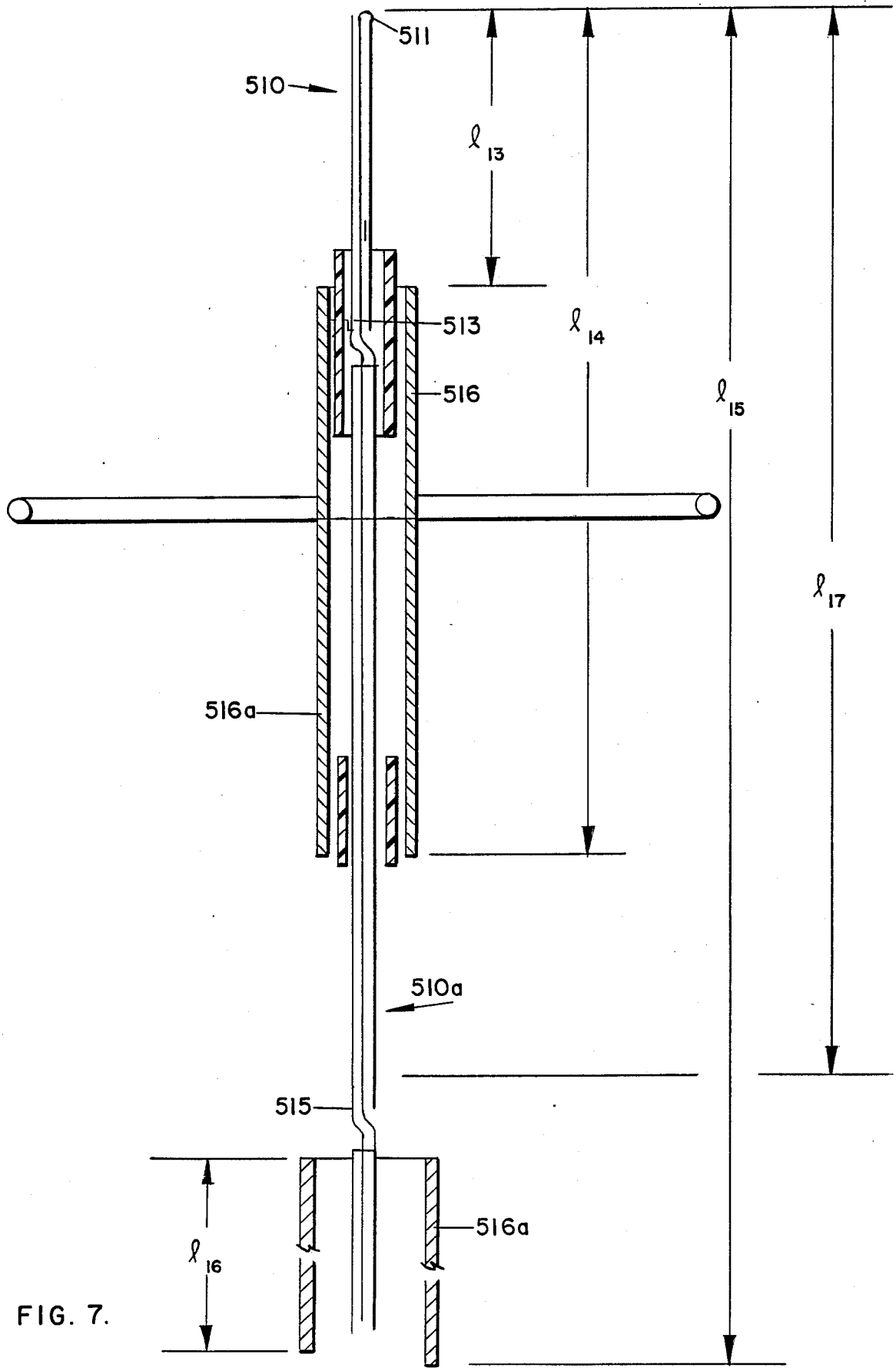
FIG. 7 is a schematic representation of a mechanism operative simultaneously at three frequencies.

Another advantage lies in the allowance of operation separately or simultaneously on multiple frequencies as dramatised in the teachings shown in the schematics, FIGS. 5–7.

Where a secondary decoupling means (i.e. a suitable vehicle surface or a ground plane GP) is encountered, see FIG. 5, a ground radial may be connected to the lower extremity of choke 316 and a matched usable frequency $f_1$ related to the length $l_8$ becomes evident. At $f_1$, $l_8$ is approximately ¼ wavelength.

Where $l_9$ is a ½ wave radiator at frequency $f_o$ and the choke is approximately ¼ wave at $f_o$, the secondary frequency will be approximate $f_{o/3}$.

A great plurality of combinations of frequencies is obviously easily attainable with this arrangement.

In FIG. 6, I have shown an alternative method for isolating the secondary frequency from a feedline 410.

$l_{10}$ would be approximately ½ wavelength at the secondary frequency.

A choke 416, formed by an extension of a prior used choke (for instance, choke 316 of FIG. 5), would be precisely tuned to the secondary frequency by dielectric 420 or by adding radials to the FIG. 6 construction, such as are shown in FIG. 7, one could substitute for choke 417 and the yield would be a ground independent antenna operational at two frequencies.

The showing in FIG. 7 is illustrative of another mechanism for operating separately or simultaneously, there being three frequencies as represented $f_o$, $f_1$ and $f_2$, each of approximately ½ wavelength relative to the lengths $l_{13}$, $l_{14}$ and $l_{15}$ respectively.

Radiator $l_{13}$ is built from a coaxial section 510 having an electrical length equal to ¾ wave at operating frequency $f_o$.

Assuming that the coaxial section has a proper velocity of propagation, $l_{13}$ would also have a physical length approximately equal to ½ wavelength at operating frequency $f_o$.

The system functions at an operating frequency $f_o$ utilizing a choke 516 similar to the FIG. 1 choke 16. A second frequency $f_1$ is operable using a choke **516*a*** and/or radials, similar to those previously referred to.

The coaxial section is short circuited at 511 providing a means for the operation of a feed point 513 at operating frequencies $f_o$ and $f_1$ without any effect on the operating frequency $f_2$.

The antenna is fed, at operating frequency $f_2$, at the feed point 515, where lower coaxial section **510*a*is cross connected to allow the upper section $l_{17}$ to function as the upper ¼ wave section with a choke 516*a*** to function as the lower ¼ wave section, the combination thus forming a ground independent, center fed ½ wave element at operating frequency $f_2$.

Choke **516*a*** may also be tuned by a dielectric, as previously described.

One application for such a three frequency mechanism is in the presently commercially available multibank scanners operating in the frequencies from 30 to 50 Mhz, 144 to 174 Mhz, and 440 to 512 Mhz.

Figure 8:
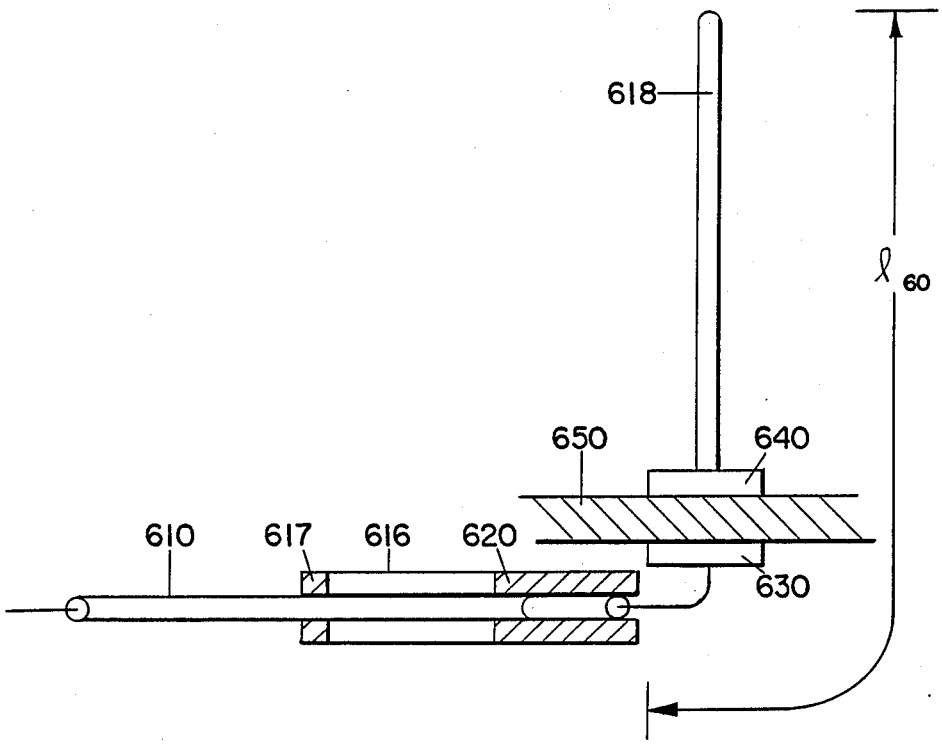
FIGS. 8 and 9 are schematic representations of an end-fed ½ wave antenna for coupling a radiator element through a non-conductive electrical element.
Figure 9:
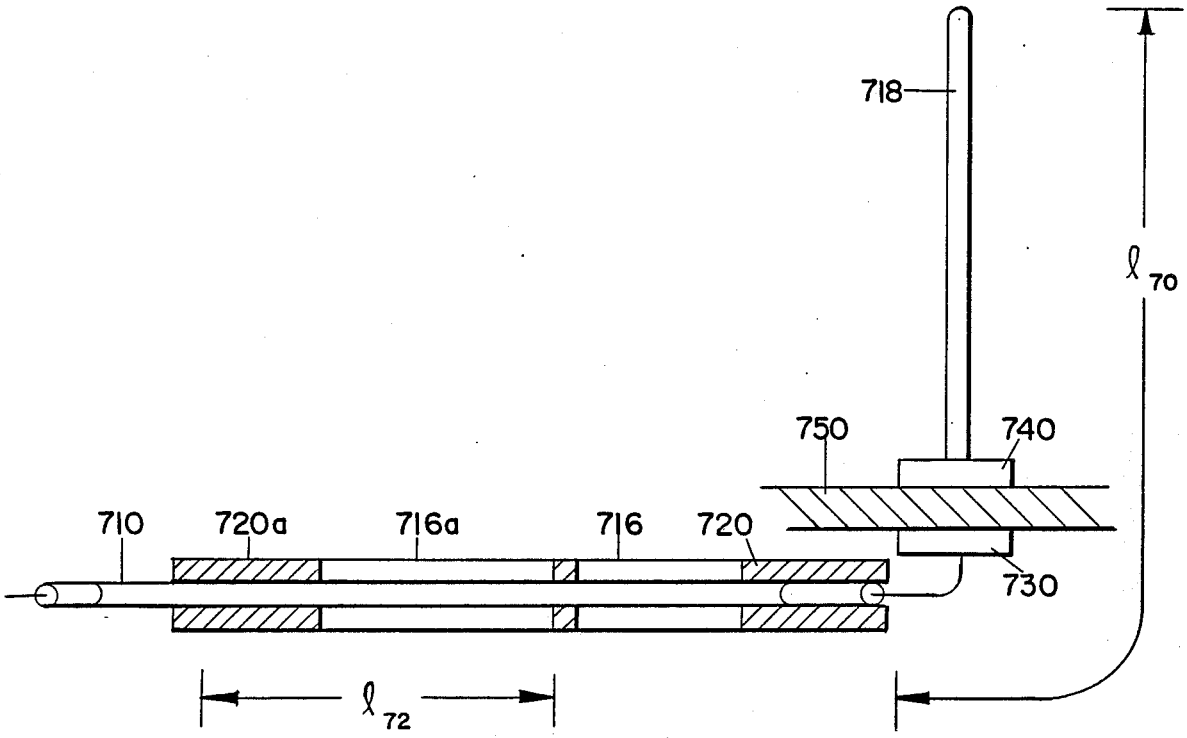

Reference is now made in FIGS. 8–9 showing means for mounting and tuning an antenna in connection with a mobile transceiver, especially where the mounting is on a non-conductive surface, i.e. on a window of a vehicle.

In FIG. 8 is shown a variation of the basic concept exploiting a dielectric slug tuned cavity for feeding and decoupling a ½ wave radiator and wherein the radiating element 618 has a certain length. The coaxial feedline is shown at 610, the tuned cavity structure is shown at 616, the short circuit of cavity bottom to feedline is shown at 617, the dielectric slug is shown at 620, and capacitor plates 630 and 640 are shown disposed on opposite sides of the nonconductive dielectric or glass 650.

The cavity mechanism 616 functions and is dimensioned, as in the FIG. 1 case, but in this instance the ½ wave radiator is not contiguous, the length being interrupted by the thickness of the nonconductive dielectric 650, with capacitor plates 630 and 640 being fixed to its opposite sides.

Energy at the operating frequency is passed to radiator 618 through the capacitive coupling device.

The capacitive reactance induced by this arrangement is compensated for by causing the radiator to have an opposing or inductive reactance, which inductance may be readily varied by lengthening or shortening the radiator.

When the dimension $l_{60}$ is approximately equal to an electrical ½ wavelength, a current minimum exists at the open end of the cavity.

By virtue of the inherent high impedance capability, the radiating element is decoupled effectively from the feedline disclosing a significant improvement in the radiating efficiency by minimizing, if not totally eliminating, distortion of the radiation pattern which is generated and which is caused by the radiation of energy from the outer surface of the feedline between the antenna feedpoint and the transmitting source.

Another method of obtaining this inductive component is exemplified by the configuration schematically represented in FIG. 9 designed for improving antenna performance by way of increasing the length in the achievement of more gain, i.e. greater field intensity.

As the length of the radiator 718 is increased, it is possible that a current minima would not exist at the open end of the cavity 716 toward the radiator. If so, current would spill over this point and would begin to flow over the outer surface of feedline 710. To control this current and thereby preserve antenna efficiency, the cavity 716 is shown as extended from the short circuit 717 and having an open end facing toward the transmitting source.

The length of this extension $l_{72}$ is approximately ¼ wavelength at the operating frequency.

The second cavity 721 is tuned precisely to the operating frequency by dielectric 723.

The open end of the second cavity 721 provides a very high impedance point to energy at the operating frequency, thereby effectively decoupling the system from the feedline.

Herefollowing, I make a continued disclosure to delineate additional applications of a ½ wave cavity fed antenna design.

In the field of modern communications, multiband antenna designs are common.

Unfortunately their construction is limited when the desired bands are not harmonically related so as to preclude the impedance matching device from operating harmonically.

In the disclosures next following, means for adding additional harmonic or nonharmonic bands to the arrangements already herein disclosed will be shown.

Such concepts are already in use having simultaneous operations at 135 to 170, 440 to 512 and 800 to 900 Mhz.

Figure 12:
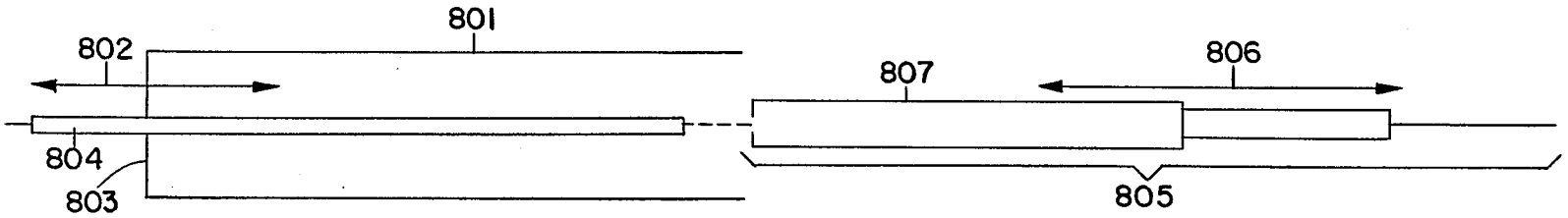
FIG. 12 is a schematic showing of a typical ½ wave antenna with a cavity which may be infinitely adjustably positioned allowing cavity resonance at any desired frequency and telescoping ½ wave element allowing infinite adjustment in its length.

In FIG. 12, I show a typical ½ wave antenna as has been previously described.

A cavity 801 has an infinitely movable range of frequency adjustment represented by 802 to allow the cavity to resonate at any desired frequency.

An adjustably positioned shorting disc 803 is provided at the bottom or closed end of the cavity circumscribing the coaxial cable 804.

Further, as shown in this version, it is to be appreciated that ½ wave element 805 can be telescoped or otherwise infinitely adjusted in length as represented by the arrow 806.

From this teaching, it is to be seen that a design could thus be produced allowing operation at any desired frequency, manual adjustments of both the cavity and the ½ element being attainable.

Conceivably, too, and keeping within the spirit of the disclosure, these adjustments could even be remotely controlled through motors, servos, or actuators, either pneumatically-operated or hydraulically-operated, a type of execution being especially desirable for a plurality of existing applications in the field of communications.

Figure 13:
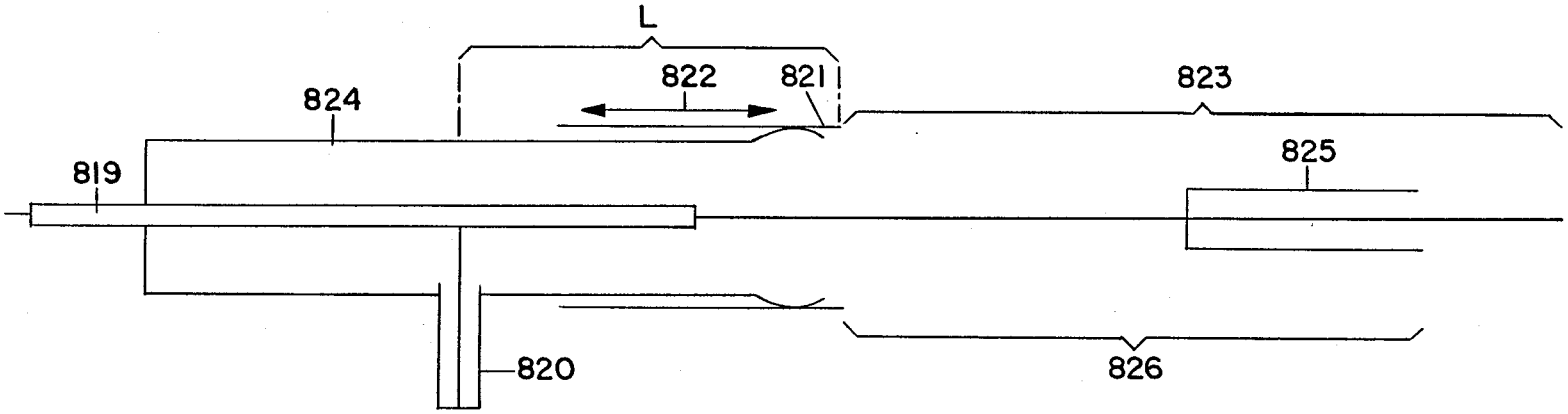
FIG. 13 is a schematic showing of another typical ½ wave antenna with a secondary ¼ wave shorted stub within the main cavity allowing a secondary ½ wave length defined between the open ends of the main and secondary cavities.

FIG. 13 exemplifies a design wherein the cavity resonance is controlled by a shorted one quarter wavelength line 820 and an adjustably positioned sleeve 821 as indicated by arrow 822.

Half wave element 823 is adjusted via the main cavity choke 824, its frequency adjustment being indicated by arrow 822.

The arrangement here shown envisions operation at a number of preset band centers, a two-band operation being shown.

The secondary ½ wave is represented by 825 and the primary ½ wave is represented by 823.

The shorted ¼ wave line 820 is resonant at the same frequency as the main cavity 824 and will D.C. short circuit the cavity at its placement at all other frequencies other than the stub's primary and harmonic resonances.

The line 820 is transparent at its primary and harmonic resonances. Accordingly, the resonance of the main cavity is not affected.

This execution can provide simultaneous operation at any number of preset band centers.

Here the operation is two band, but additional stubs may be employed to create simultaneously additional bands of operation.

And the addition of ground simulating radials or a mounting on a vehicle body, as already discussed, would add an additional band.

One secondary ¼ wave shorted stub is concentrically positioned within the main cavity, with a short circuit 824 at the top of the stub providing a D.C. short for energy at the resonant frequency of the stub.

The ¼ wave shorted line 820 preferentially is placed downwardly from the open end of main cavity 824 a distance L equal to ¼ wave at the desired secondary frequency. The combination will have the effect of creating a secondary ½ wave length cavity defined between the open end of the main cavity 824 and the position of the attachment of the shorted ¼ wave line 820. This will cause secondary element 825 to operate as ½ wave length at the secondary frequency.

It is the intention to teach that this execution can provide secondary operating frequencies not harmonically related to the resonance and harmonies of the main cavity 824.

A sliding sleeve 821 at the upper open end of main cavity 824 permits minor shifts in the fine tuning of the band centers and advantageously allowing some variations in the individual band widths.

Conceivably, sleeve 821 could be remotely controlled by a motor (not shown) for ease in tune-up operation.

Figure 14:
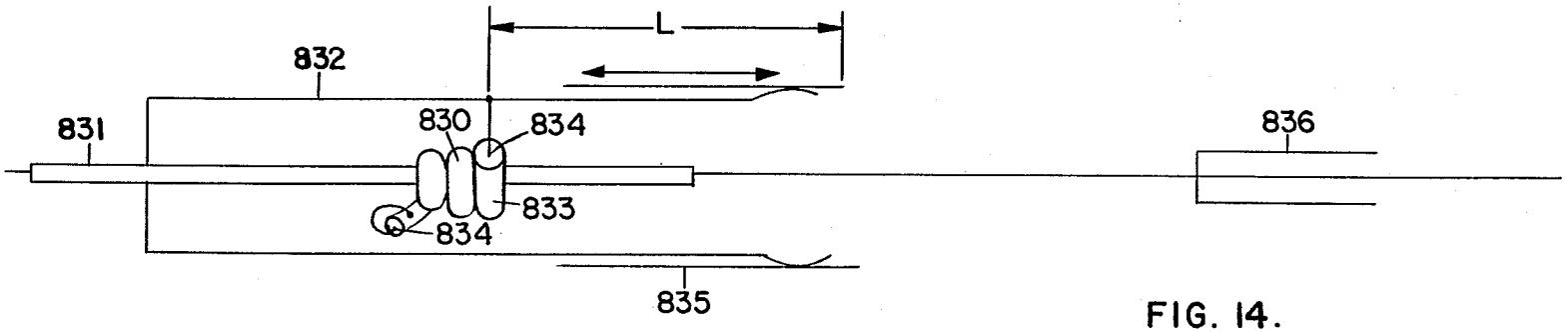
FIG. 14 is a schematic showing similar to the FIG. 13 showing but distinguished therefrom in the respect that the ¼ wave shorted stub is comprised of a coaxial cable convoluted in enwrapment around the feedline coaxial cable in the main cavity.

In FIG. 14, I have shown, as in the FIG. 13 teaching, the employment of a shorted ¼ wave line or stub 830 which comprises a coaxial cable wrapped around a coaxial feedline 831 in the main cavity 832.

The shorted ¼ wave line 830 is shown to be of a construction such as a commonly available small diameter semi-rigid coaxial cable having soft copper tubing 833 as an outer conductor and a silver plated steel wire 834 as a center conductor and a dielectric insulation such as Teflon typically used in such.

In FIG. 14, the intention is to show the soft copper conductor as being attached to the outer conductor of coaxial cable 831 by soldering or other such means and the center conductor 834 similarly attached to the inner wall of choke 832, a distance L from the open end of the cavity as may be adJusted by sleeve 835, this execution defining a cavity as previously described.

Figure 10:
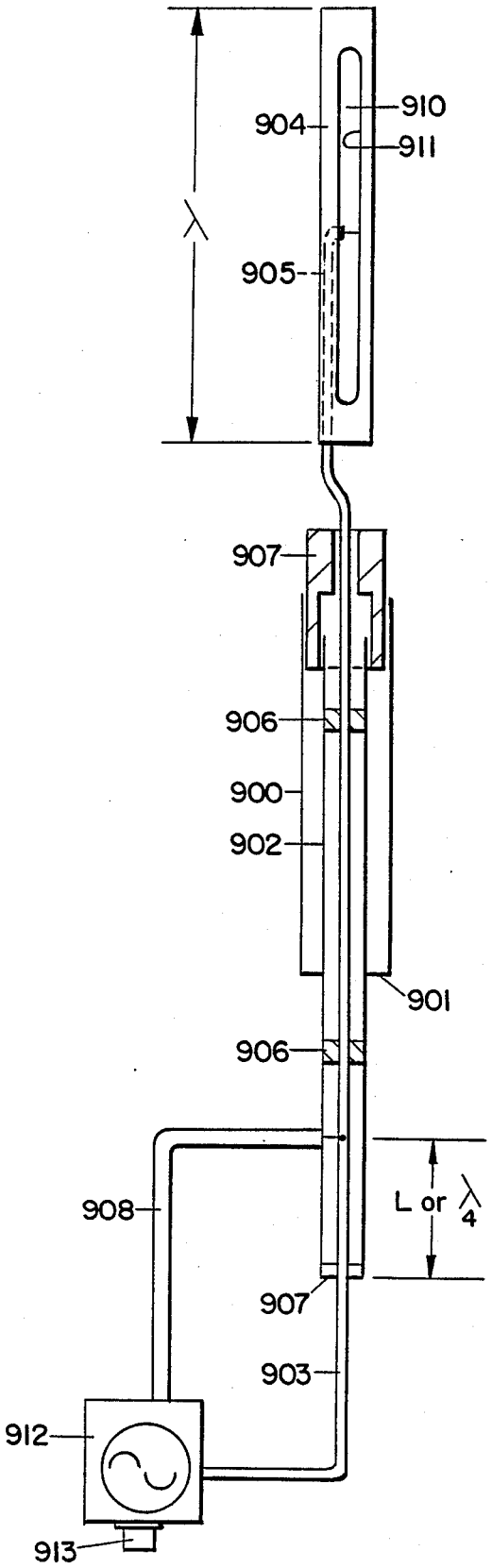
FIG. 10 is a schematic representation of a means for obtaining circular polarized radiation wherein energy at the same operating frequency is fed by means of a phase shift of 90 degrees so as to produce an omnidirectional circularly polarized magnetic field, the cavity execution of the end fed ½ wave antenna being the same as in the earlier exemplifications.

Reference is now made to FIG. 10 showing a means for obtaining circular polarized radiation, energy at the same operating frequency is fed by means of a phase shift of 90 degrees so as to produce an omnidirectional circularly polarized magnetic field.

In FIG. 10, I illustrate a modification of the cavity execution of the end fed ½ wave antenna for the achievement of circular polarization.

Therein an outer shell 900 provides the cavity which is short circuited at 901 to the outer conductor 902 of the coaxial feedline further identified by 903 a representative of the inner conductor thereof.

The coaxial feedline is connected to an element 904 at a point 905 although it is to be understood that the connection can be made at any point along the length of the element.

Element 904 will be seen to serve as a vertically-polarized, omnidirectional radiator.

As shown, the outer conductor 902 of the coaxial feedline is supported concentrically relative to the inner conductor by dielectric washers 906 and is short circuited to the feedline 903 at 907.

Element 904 is fed as an end fed ½ wave radiator as heretofore described, the cavity being tuned by a dielectric slug 907.

The RF energy is introduced to element 904 as an end fed radiator through a coaxial cable 908 at a distance L above short circuit 907, length L being proportioned to form a shorted ¼ wave section at the operating frequency, a feature allowing a D.C. ground for the antenna and additionally isolating the feed point.

The fed energy excites element 904 serving, as aforesaid, as the vertically-polarized omnidirectional radiator.

Element 904 is tubular in configuration and is provided with a slot 910 along its length.

RF energy is fed through coaxial cable 903 to slot 910 at a point therealong enumerated 911, the point where outer conductor of the coaxial cable connects to the inner wall of element 904 and the inner conductor extends across the slot to be attached to the opposite edge of the slot, as shown.

Where the diameter of element 904 is approximately ⅛ wave or less, at the operating frequency, the energy fed serves to excite the element as an omnidirectional horizontally-polarized radiator.

Such a phase shift device is illustrated schematically at 912, same being so well known in the industry as to make further description seemingly unnecessary, the phase shift device being fed by a common feed point 913.

Alternatively, in lieu of a phase shift device, the lengths of feeder cables 908 and 903 could be so proportioned as to their lengths as to provide the requisite phase feature.

Obviously, according to this arrangement polarization in either the left or right hand sense may be selectively provided for.

While circular polarization is here identified, it is to be understood that the design is capable of operation with separate vertical or horizontal signal modes. Too a dual band encompassing separate frequency signals is conceivable and as previously described a variety of multifrequency executions of a cavity fed ½ wave device are to be considered as coming within the purview of the invention.

That is, the arrangement envisions a radiator which can radiate only vertically or only horizontally and in right circular or left circular directions, any phase relationship of horizontal and vertical radiation being attainble.

Further, in a dual band, the antenna could be operable horizontally at one frequency and operable vertically at another.

Figure 11:
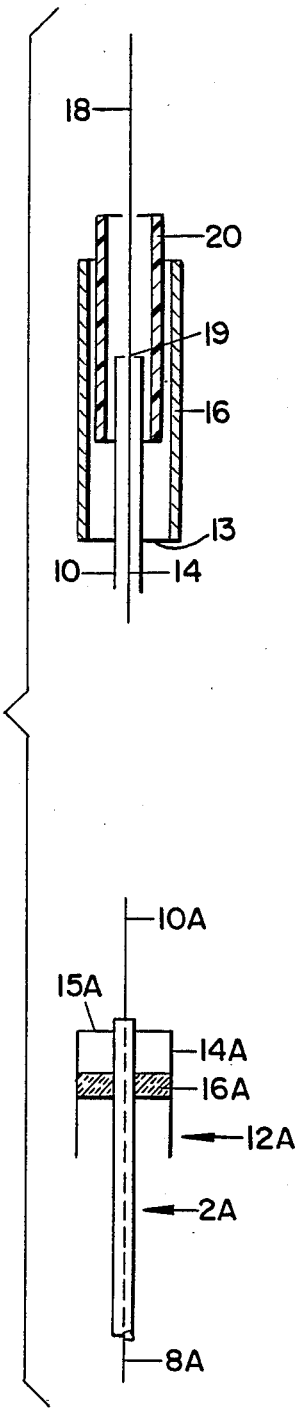
FIG. 11 is a side-by-side representation of the end-fed antenna of the invention and the antenna of Ploussios, #4,509,056, for purposes of dramatising the essential differences therebetween.

Finally, and with reference to FIG. 11, the basic differences between the invention of this application and the invention of Ploussios as set forth in his patent #4,509,056 perhaps can best be dramatised by a side-by-side comparison.

The upper figure within the bracket identifies Applicant's invention as shown in FIG. 1 hereof wherein are shown feedline 10 (outer conductor 12 and inner conductor 14), feedpoint 19, choke 16 with its lower closed end shorted at 17 and its upper opened end facing toward the feedpoint, as well as dielectric material 20.

Ploussios on the other hand shows a feedline 10 and a choke 14 with its upper end closed.

Ploussios uses his choke to define the outward end of an antenna which is fed at a low impedance point and clearly shown as a center fed ½ wave dipole, known to have an impedance value of approximately 70 ohms (or a ¼ wave monopole fed against a ground surface known to have an impedance value of approximately 35 ohms).

The invention hereof contemplates utilization at a high impedance feedpoint such as the approximate 100,000 ohms feed point at the end of a ½ element.

Ploussios in no way teaches utilization of a choke as a feed point impedance matching device. He adjusts the dielectric in his choke to create an infinite impedance at the open end of the choke, not the feedpoint. It is clearly Ploussios's intention to use this infinite impedance to isolate the various bands of his multi-frequency from each other.

The Ploussios choke teaches shorting at one end with the other open end being positioned away from the antenna feed point.

This again shows no correlation to the invention hereof where the choke, shorted at one end has the open end not only facing towards the feedpoint but rather surrounds the feed point, this situation along with the choke function serving to provide a feedpoint impedance transformation between the coaxial feed line (typically 50 ohms.) and high impedance (approximately 100,000 ohms) at the end of a ½ wave element.

I claim:

1. A mechanism for matching the impedance of an antenna radiator to the impedance of its feed line and for isolating the radiator from the feed line comprising:

a transmission feed line having inner and outer conductors, a radiator feedpoint located at the upper terminus of the outer conductor, the inner conductor having an extension extending beyond the feedpoint and defining a complete ½ wavelength radiator, a cavity choke having an opened end and a closed end and circumscribing and in spaced relation to the feed line, the closed end being electrically connected to the outer conductor of the feed line, the opened end surrounding the feedpoint, a dielectric means positionable between the choke and outer conductor for tuning by resonating the cavity of the choke and forming a high impedance at the cavity's opened end while simultaneously attaining feedpoint impedance matching.

2. In a tunable antenna, mechanism for matching radiator impedance to feed line impedance and isolating the radiator from the feed line comprising:

a coaxial feed cable having inner and outer conductors, a radiator feedpoint at the upper terminus of the outer conductor, an extension of the inner conductor extending beyond the feedpoint to define a complete ½ wavelength radiator, a choke having a conductive member circumscribing the coaxial feed cable and having an opened end facing toward the radiator, a means positionable between the conductive member and outer conductor of the coaxial feed cable for adjusting the resonant frequency of the choke to a precisely one-quarter wave transmission line at the antenna's frequency of operation.

3. A tunable antenna comprising, a flexible radiating member formed from an extension of the inner conductor of a coaxial cable consisting of inner and outer conductors, a choke circumscribing the coaxial cable and having a closed end and an opened end, the closed end of the choke being electrically connected to the outer conductor of the coaxial cable, a dielectric material positioned between the choke and the outer conductor of the coaxial cable, the opened end of the choke facing toward the radiating member to provide an impedance matching device for matching the impedance of the radiator to the impedance of the coaxial cable and the isolation of the choke to preclude current flow exteriorly of the choke thereby isolating the radiator from the coaxial cable.

4. In an antenna, the combination of:

a coaxial transmission feed line including an outer conductor and an inner conductor extending beyond the terminus of the outer conductor in defining an entire radiator, a choke comprising a conductive member circumscribing the feed line and having an opened end and a closed end connected electrically to the outer conductor, a loading means in the form of a dielectric material positioned between the choke inner surface and the outer conductor, the choke and outer conductor forming an open quarter wave cavity at substantially the frequency of operation to resonate the cavity formed by the choke inner surface and the outer conductor for simultaneously attaining impedance matching of the radiator to the coaxial transmission feed line and isolating the radiator currents from the coaxial transmission feed line.

5. In an antenna comprising:

inner and outer conductors of a unbalanced coaxial cable, a balanced feedpoint at the upper terminus of the outer conductor, the inner conductor having an extension extending beyond the feedpoint and defining an entire ½ wavelength radiator, a choke having an upper opened end and a lower closed end connected electrically to the outer conductor of the coaxial cable, the outer conductor and inner surface of the choke forming an open quarter wave transmission line at substantially the frequency of operation for matching the impedance of the radiator to the impedance of the coaxial cable and simultaneously transforming the balanced feedpoint to the unbalanced coaxial cable while preventing a flow of current on the outer surface of the choke and coaxial cable thereby isolating the radiator currents.

6. In the antenna as claimed in claim 5 wherein the choke includes a loading means for adjusting the resonant frequency of the choke to a precise one-quarter wavelength at the operating frequency of the antenna.

7. An antenna as claimed in claim 6 wherein the loading means comprises a dielectric material positioned between the inner surface of the choke and outer conductor.

8. In an antenna, the combination of:

a coaxial transmission feed line including an outer conductor and an inner conductor extending beyond the terminus of the outer conductor in defining an entire radiator, a choke circumscribing the inner conductor and having an opened end and a closed end, the closed end being connected electrically to the outer conductor, a loading means positioned between the inner surface of the choke and the outer conductor, the choke and outer conductor forming an open quarter wave transmission line at substantially the frequency of operation for simultaneously attaining impedance matching and balanced-to-unbalanced transformation and current isolation.

9. In a tunable antenna, mechanism for matching the impedance of a radiator to the impedance of a feed line while isolating the radiator from the feed line comprising:

an unbalanced coaxial feed line having inner and outer conductors, an extension of the inner conductor beyond a balanced feedpoint at the upper terminus of the outer conductor for defining a ½ wavelength radiator, a choke assembly circumscribing the coaxial feed cable, and having opposite closed and opened ends, the closed end of the choke being electrically connected to the outer conductor, the opened end of the choke facing toward the radiator, a dielectric positionable between the choke and outer conductor for adjusting the resonant frequency of the choke to a precisely one-quarter wave transmission line at the frequency of operation of the antenna and forming a high impedance at the opened end of the choke to preclude current flow along the choke outer surface while at the same time attaining a feedpoint impedance matching and a transition of the balanced feedpoint to the unbalanced feedline.

10. In a tunable dipole antenna, a mechanism for matching the impedance of a radiator to the impedance of a feed line while isolating the radiator from the feed line comprising:

an unbalanced coaxial feed line having inner and outer conductors with an extension of the inner conductor beyond a balanced feedpoint of the dipole antenna at the terminus of the outer conductor defining an entire radiator, an isolation choke circumscribing and in spaced relation with the feed line outer conductor and having an opened end and a closed end, the closed end being electrically connected to the outer conductor, the opened end facing toward the radiator, the choke and feed line outer conductor forming an open quarter wave transmission line at substantially the frequency of operation, means positionable between the choke and outer conductor of the feed line for precluding current flow along the outer surface of the choke while simultaneously attaining impedance matching and a transformation of the balanced feedpoint to the unblanced feed line.

11. In a tunable dipole antenna, a mechanism for matching the impedance of a radiator to the impedance of a feed line and for isolating the radiator currents from the feed line comprising:

an unbalanced coaxial feed line having inner and outer conductors, a balanced radiator feedpoint located at the upper terminus of the outer conductor, an extension of the inner conductor beyond the feedpoint defining the entire radiator, a choke in the form of a cylindrical conductive member circumscribing and in spaced relation to the feed line outer conductor, the choke having opposite opened and closed ends, the closed end being electrically connected to the outer conductor, the opened end surrounding the feedpoint in forming a resonant cavity, a dielectric adjustably positionable between the choke and outer conductor of the feed line for resonating the formed cavity at the frequency of operation and forming a high impedance at the cavity's opened end for precluding current flow along the outer surface of the choke and the feed line while simultaneously attaining feedpoint impedance matching and transition of the balanced feedpoint to the unbalanced feed line.

12. In an antenna assemblage for simultaneously matching the impedance of a half wave radiator to the impedance of a feed line and providing a balancing circuit as an impedance transformer and preventing the flow of current in the isolation of the radiator from the feed line, the combination of:

an electrical source, an unbalanced coaxial transmission line having inner and outer conductors connected at one end to the source, a coaxial transmission line having inner and outer conductors connected at one end to the source, the inner conductor having an extended portion extending outwardly of the outer conductor in defining the half wave radiator with a point of emergence of the inner conductor defining a balance feedpoint, a choke circumscribing the coaxial line and having opposite opened and closed ends, the closed end of the choke being shorted to the outer conductor, the opened end of the choke facing toward the radiator, a loading means sleeved within the choke and circumscribing the coaxial line for precisely tuning the choke for resonance to an operating frequency and by virtue of a high impedance at the opened end of the choke serving as well to define the high impedance end of the half wave radiator whereat the radiating currents are minimal and the current flow along the outer choke surface is minimized for isolating the radiator from the coaxial line while simultaneously transitioning a balanced feedpoint to an unbalanced coaxial transmission line.

* * * * *